US007705704B2

(12) United States Patent
Lee et al.

(10) Patent No.: US 7,705,704 B2
(45) Date of Patent: Apr. 27, 2010

(54) INDUCTOR STRUCTURE

(75) Inventors: Sheng-Yuan Lee, Taipei Hsien (TW); Hsiao-Chu Lin, Taipei Hsien (TW)

(73) Assignee: Via Technologies, Inc., Taipei Hsien (TW)

( * ) Notice: Subject to any disclaimer, the term of this patent is extended or adjusted under 35 U.S.C. 154(b) by 0 days.

(21) Appl. No.: 12/051,511

(22) Filed: Mar. 19, 2008

(65) Prior Publication Data

US 2009/0167476 A1 Jul. 2, 2009

(30) Foreign Application Priority Data

Dec. 26, 2007 (TW) ..... 96150322 A

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 21/02*** | (2006.01) |

(52) U.S. Cl. ..... 336/200; 336/232; 336/223; 336/192; 336/147

(58) Field of Classification Search ..... None
See application file for complete search history.

(56) References Cited

U.S. PATENT DOCUMENTS

| | | | | |
|---|---|---|---|---|
| 5,095,357 | A * | 3/1992 | Andoh et al. | 257/379 |
| 6,278,354 | B1 * | 8/2001 | Booth | 336/200 |
| 6,714,112 | B2 | 3/2004 | Beng et al. | |
| 6,812,819 | B2 * | 11/2004 | Le Grand de Mercey et al. | 336/200 |
| 6,882,263 | B2 * | 4/2005 | Yang et al. | 336/200 |
| 6,922,128 | B2 * | 7/2005 | Vilander et al. | 336/200 |
| 6,972,658 | B1 * | 12/2005 | Findley et al. | 336/200 |
| 7,382,222 | B1 * | 6/2008 | Manetakis | 336/200 |
| 2002/0067235 | A1 * | 6/2002 | Ueda et al. | 336/200 |
| 2003/0137383 | A1 * | 7/2003 | Yang et al. | 336/200 |
| 2004/0085175 | A1 * | 5/2004 | Lowther | 336/200 |
| 2005/0052272 | A1 * | 3/2005 | Tiebout | 336/232 |
| 2006/0284718 | A1 * | 12/2006 | Baumgartner et al. | 336/223 |

* cited by examiner

*Primary Examiner*—Elvin G Enad
*Assistant Examiner*—Mangtin Lian
(74) *Attorney, Agent, or Firm*—J.C. Patents

(57) ABSTRACT

An inductor structure disposed over a substrate and including a coil layer is provided. The coil layer has a plurality of coil turns electrically connected with each other. An innermost coil turn of the coil layer has a portion with a narrower width in a region with a higher magnetic flux density than that in the other region with lower magnetic flux density.

16 Claims, 6 Drawing Sheets

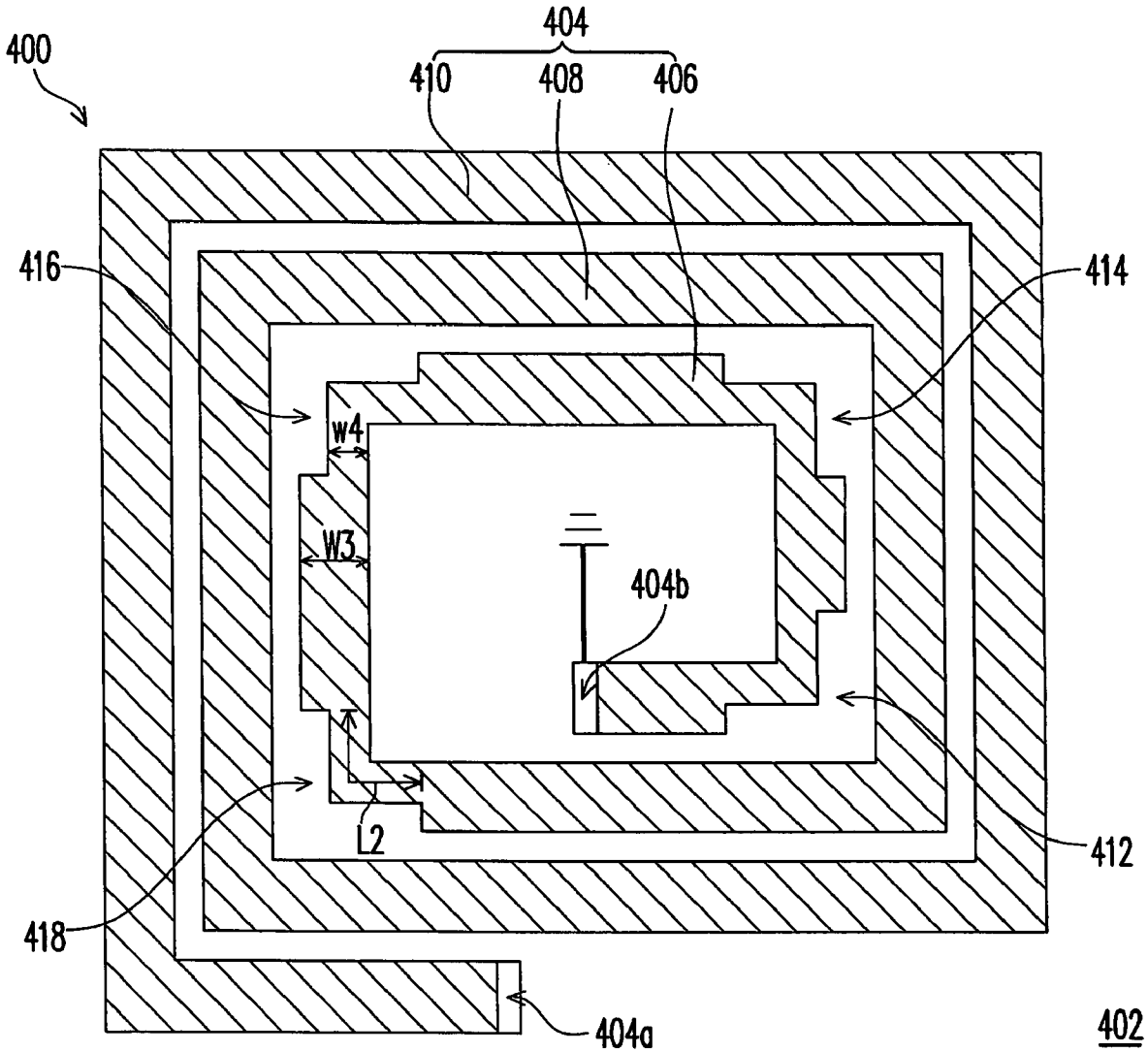
402 FIG. 4

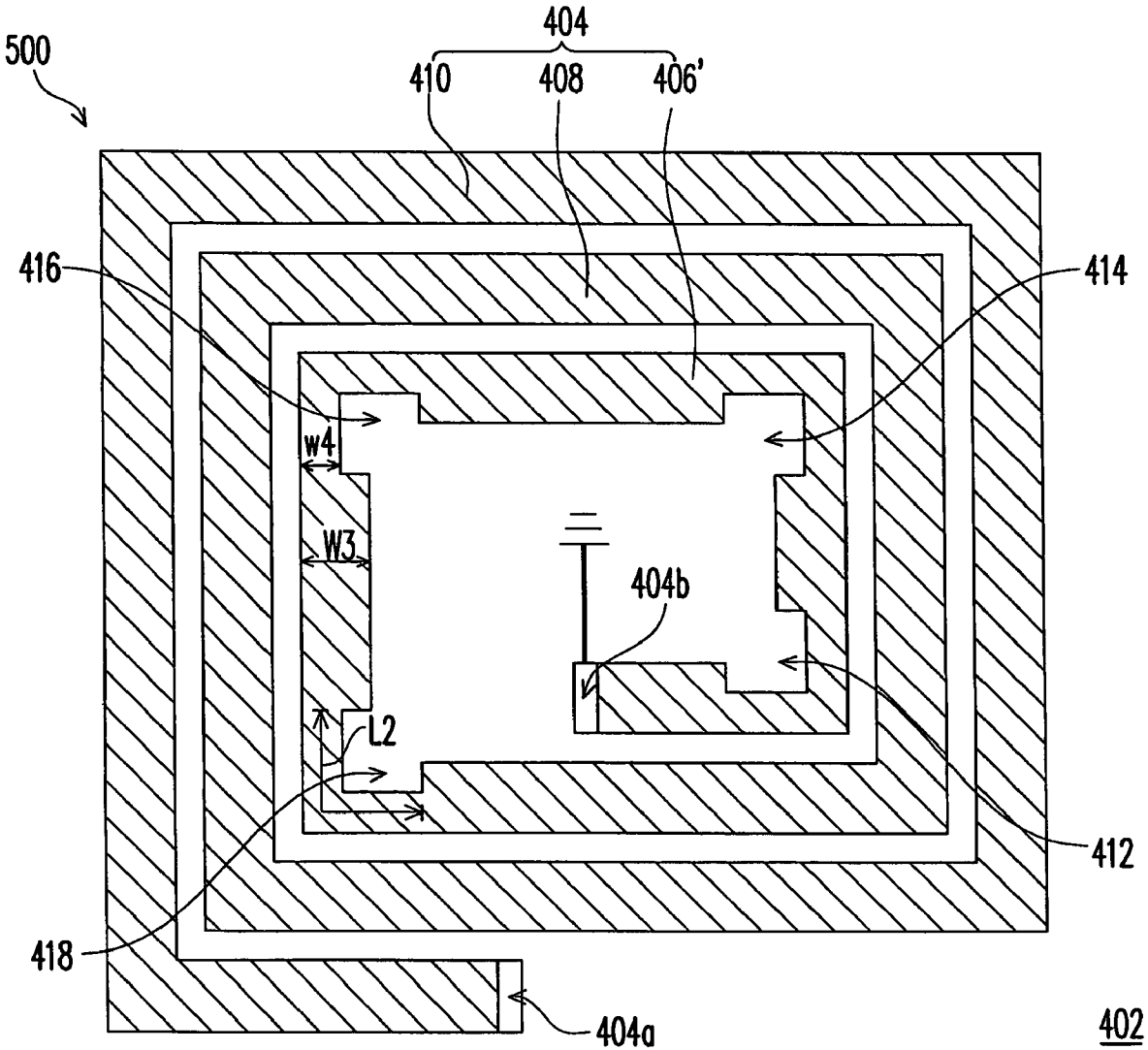
402 FIG. 5

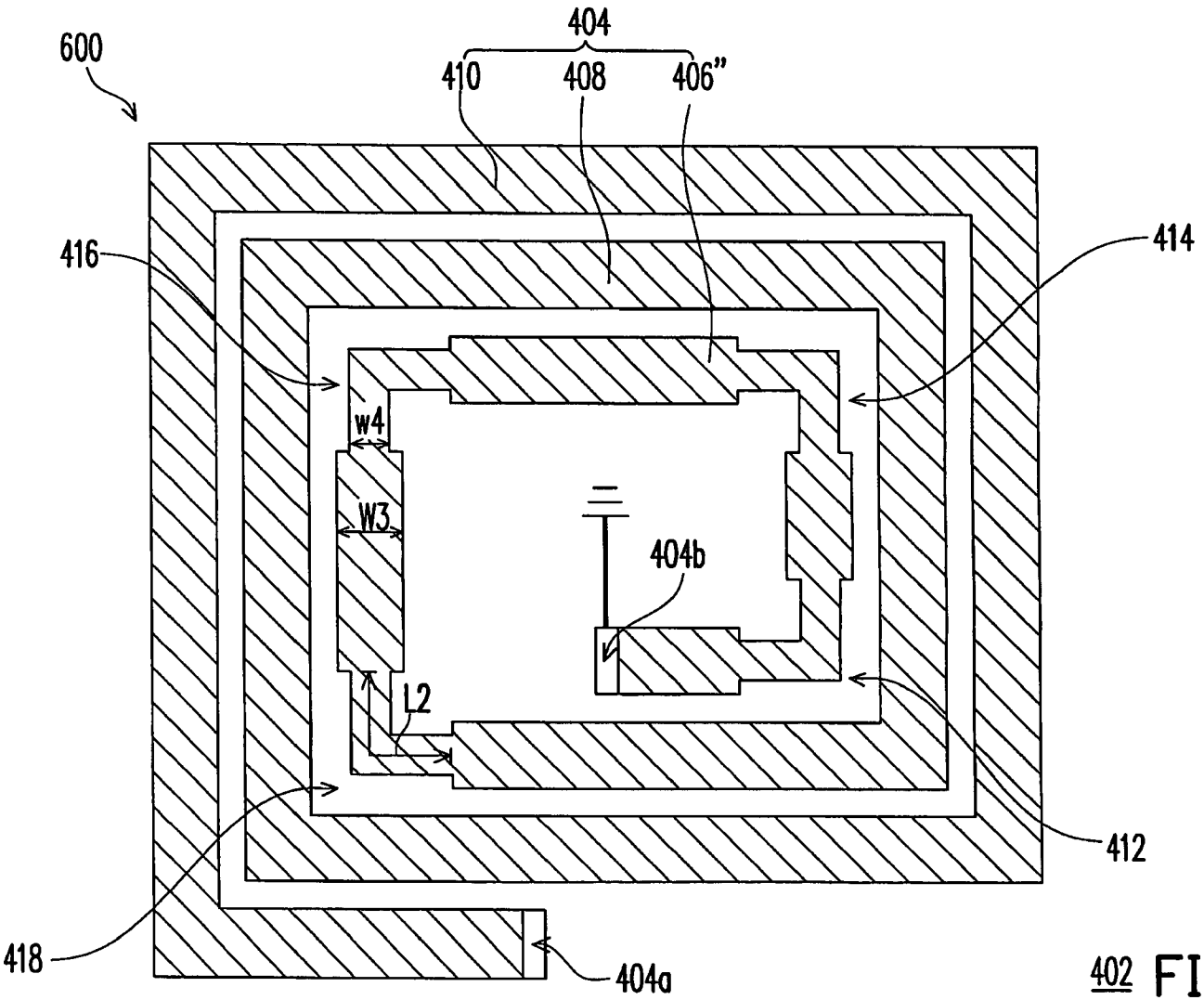
402 FIG. 6

INDUCTOR STRUCTURE

CROSS-REFERENCE TO RELATED APPLICATION

This application claims the priority benefit of Taiwan application serial no. 96150322, filed on Dec. 26, 2007. The entirety the above-mentioned patent application is hereby incorporated by reference herein and made a part of specification.

BACKGROUND OF THE INVENTION

1. Field of the Invention

The present invention generally relates to an inductor structure, in particular, to an inductor structure with an improved induction quality.

2. Description of Related Art

Generally speaking, inductors can store/release energy under the condition of electromagnetic conversion, and the inductors may be used as elements for stabilizing current. In addition, in integrated circuits (IC), the inductors play an important role but are challenging elements. The inductors have wide applications, for example, in radio frequency (RF). In the high-frequency application, the inductor is required to have a very high quality, i.e., the inductor must have a high quality factor denoted by a Q value. The Q value is defined as follows:

$$Q=\omega\times L/R$$

where ω is the angular frequency, L is the inductance of a coil, and R is the resistance at a specific frequency taking the inductance loss into account.

Generally speaking, a variety of methods and techniques have been proposed for integrating inductors with IC processes. However, in the ICs, the limitation of the thickness of the inductor conductor and the interference of the silicon substrate to the inductor will also lead to unsatisfactory inductor quality. In the prior art, a thick metal is disposed on the top layer of the inductor to reduce the conductor loss, so as to improve the Q value of the inductor.

However, the inductor structure with a thick metal disposed on the top layer thereof is still affected by an eddy current. Since the region with the largest magnetic flux is located in the inner turn of the inductor structure, and especially the impact of the eddy current on the bends of the inner turn is most severe, the uniformity of the current in the inner turn is poor, and the cross-sectional area of the conductor cannot be fully used. Therefore, the inductor quality is degraded.

SUMMARY OF THE INVENTION

Accordingly, the present invention is directed to an inductor structure, capable of alleviating the impact of the eddy current, thereby improving the inductor quality.

The present invention provides an inductor structure disposed over a substrate and including a coil layer. The coil layer has a plurality of coil turns electrically connected with each other. An innermost coil turn of the coil layer has a portion with a narrower width in a region with a higher magnetic flux density than that in the other region with lower magnetic flux density.

The present invention further provides another inductor structure disposed over a substrate and including a first spiral coil and a second spiral coil. The second spiral coil and the first spiral coil are wound symmetrically about a symmetry plane. One terminal of the second spiral coil is connected to that of the first spiral coil, so as to form a coil layer having a plurality of coil turns. Each of the coil turns is in a shape of polygon with several bends. In addition, an innermost coil turn of the coil layer has a portion with a narrower width at each of at least two bends.

The present invention also provides an inductor structure disposed over a substrate and including a coil layer. The coil layer is formed by a plurality of serially-connected coil turns, and each of the coil turns is in a shape of polygon with several bends. In addition, an innermost coil turn of the coil layer has a portion with a narrower width at at least one bend.

In order to the make aforementioned and other objects, features and advantages of the present invention comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 4 is a top view of an inductor structure according to a fourth embodiment of the present invention.

FIG. 5 is a top view of an inductor structure according to a fifth embodiment of the present invention.

FIG. 6 is a top view of an inductor structure according to a sixth embodiment of the present invention.

DESCRIPTION OF THE EMBODIMENTS

Figure 1:
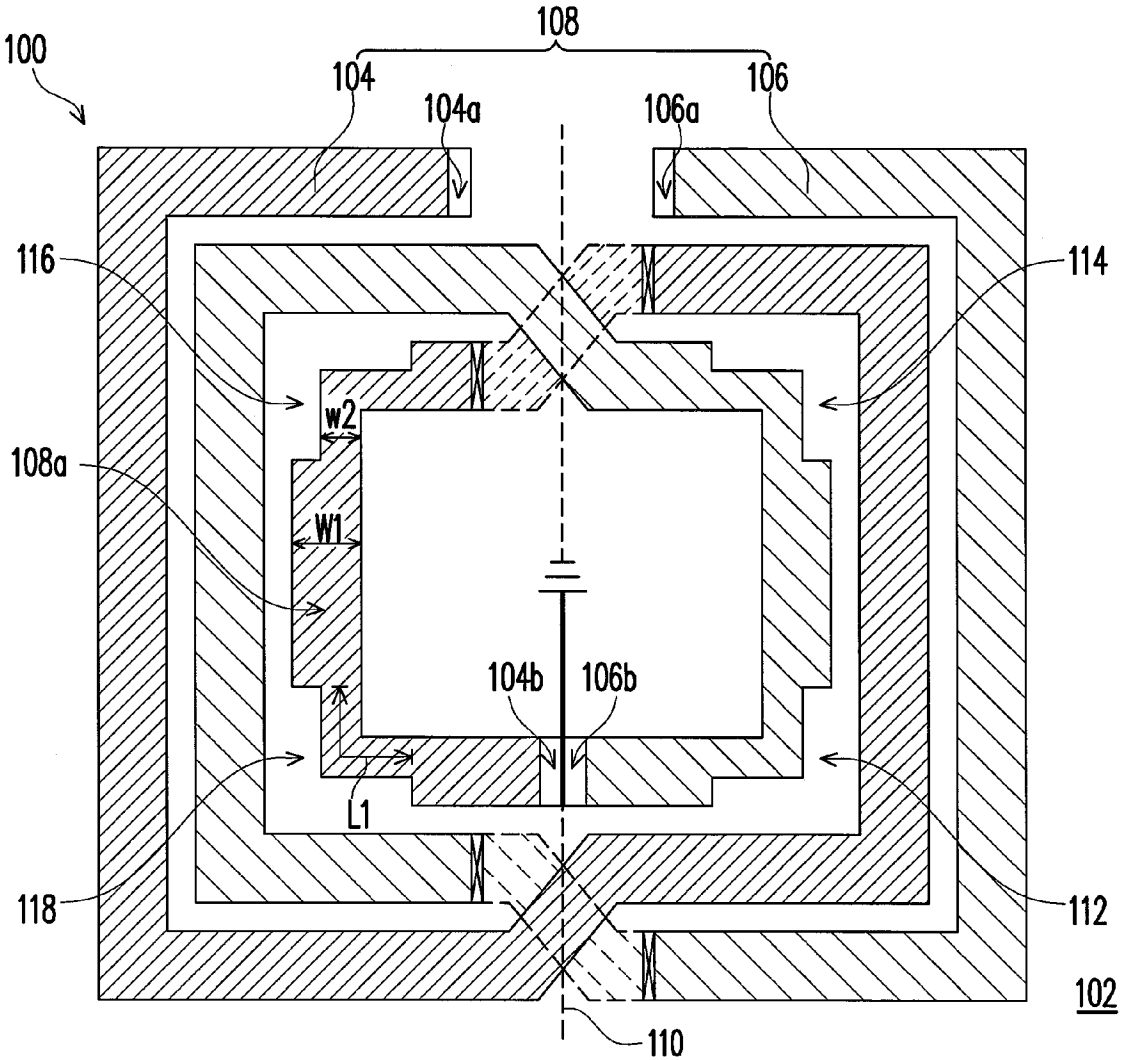
FIG. 1 is a top view of an inductor structure according to a first embodiment of the present invention.

Reference will now be made in detail to the present embodiments of the invention, examples of which are illustrated in the accompanying drawings. Wherever possible, the same reference numbers are used in the drawings and the description to refer to the same or like parts.

In this specification, an inner side or an outer side of a coil is defined as: in a width direction of the coil, the side facing the interior of the inductor structure is referred to as the "inner side," and the side far away from the interior of the inductor structure is referred to as the "outer side."

Since the region with the largest magnetic flux is located in an inner turn of the inductor structure, and the higher magnetic flux density incurs the greater eddy current, a severe current cancellation may occur between the eddy current and the induction current of the inductor, and thus the conductor loss is increased, and the inductor quality is degraded.

Therefore, in the inductor structure of the present invention, the innermost coil turn has a portion with a narrower width in a region with a higher magnetic flux density than that in the other region with lower magnetic flux density, thus effectively reducing the eddy current and improving the inductor quality. Further, since the inductor structure of the present invention has a portion with a narrower width, the parasitic capacitance between two adjacent coils is reduced, and the inductor quality is improved.

A polygonal inductor structure is taken as an example for illustration below. The polygonal inductor structure is, for example, but not limited to, a quadrangular inductor structure. In addition, in the polygonal inductor structure, the region with a higher magnetic flux density is, for example, located at the bend of the polygon.

FIG. 1 is a top view of an inductor structure according to a first embodiment of the present invention.

Referring to FIG. 1, the inductor structure 100 is disposed over the substrate 102, and includes spiral coils 104, 106. Since the inductor structure 100 may be realized by a semiconductor process, the substrate 102 may be a silicon substrate. The spiral coils 104, 106 may be made of a metal, for example, Cu or Al—Cu alloy. Further, in this embodiment, the inductor structure 100 is, but not limited to, polygonal-shaped, as shown in FIG. 1.

The spiral coils 104, 106 are, for example, disposed on the planes at the same level. The spiral coils 104, 106 are wound to form a coil layer 108 with a plurality of coil turns (for example, but not limited to, three turns as shown in FIG. 1). The spiral coils 104, 106 are disposed symmetrically about a symmetry plane 110. The symmetry plane 110 extends, for example, into the paper.

The spiral coil 104 has terminals 104*a*, 104*b*. The terminal 104*a* is disposed out of the spiral coil 104, and the terminal 104*b* is threaded into the spiral coil 104.

The spiral coil 106 and the spiral coil 104 are wound about the symmetry plane 110, and are electrically connected in series. The spiral coil 106 has terminals 106*a*, 106*b*. The terminal 106*a* is, for example, disposed at a position corresponding to the terminal 104*a*, and out of the spiral coil 106. The terminal 106*b* is, for example, disposed at a position corresponding to the terminal 104*b*, and is threaded into the spiral coil 106. The terminal 104*b* and the terminal 106*b* are connected on the symmetry plane 110. That is, the spiral coils 104, 106 are joined at the innermost turn of the coil layer 108.

In view of the above, when operating the inductor structure 100, for example, an operating voltage is applied to the terminal 104*a* and the terminal 106*a* respectively at the same time. Further, the voltages applied to the terminal 104*a* and the terminal 106*a* have, for example, the same absolute value but opposite electrical properties. Thus, the absolute value of the voltage gradually descends from the terminals 104*a*, 106*a* to the interiors of the spiral coils 104 and 106. The voltage at the junctions of the terminal 104*b* of the spiral coil 104 and the terminal 106*b* of the spiral coil 106 is 0. That is, an innermost coil turn 108*a* of the coil layer 108 is virtually grounded, which is the application of a symmetrical differential inductor.

It should be noted that, in the first embodiment, for example, the spiral coils 104, 106 are joined at the innermost turn of the coil layer 108, and the innermost coil turn 108*a* of the coil layer 108 is virtually grounded. However, in other embodiments, the two wound spiral coils may be joined at an outermost turn of the coil layer, such that the outermost coil turn of the coil layer may be virtually grounded.

In the inductor structure 100, each of the coil turns is in a shape of quadrangle with four bends. The innermost coil turn 108*a* of the coil layer 108 has a portion with a narrower width at each of four bends 112, 114, 116, 118. It should be noted that though in this embodiment, the innermost coil turn 108*a* has a portion with a narrower width at each of the four bends 112, 114, 116, 118, the eddy current and the parasitic capacitance can be reduced, as long as the inductor structure 100 has a portion with a narrower width at each of at least two bends that are symmetrical about the symmetry plane 110.

The structure of the innermost coil turn 108*a* is formed by, for example, removing a portion of the coil at the outer side of the innermost coil turn 108*a* with an initial width W1 at each of the four bends 112, 114, 116, 118, so as to form a narrower width W2 at each of the four bends 112, 114, 116, 118.

It should be noted that the eddy current can be reduced as long as the width W2 at each bend is smaller than the width W1, and those of ordinary skill in the art can adjust the width W2 according to design requirements of the inductor structure 100. On the other hand, the length L1 of the portion with a narrower width W2 in the innermost coil turn 108*a* is not particularly limited, and those of ordinary skill in the art can adjust the length L1 according to design requirements of the inductor structure 100.

It may be known from the first embodiment that the innermost coil turn 108*a* of the inductor structure 100 has portions with a narrower width in regions with a higher magnetic flux density (i.e., at the bends 112, 114, 116, 118), and thus the eddy current can be greatly reduced so as to improve the inductor quality. Moreover, since the flow path of the induction current of the inductor structure 100 is not changed, the inductance will not be affected.

In addition, since the innermost coil turn 108*a* of the inductor structure 100 has portions with a narrower width, the parasitic capacitance between two adjacent coils can be reduced, and thus the inductor quality can be improved.

Figure 2:
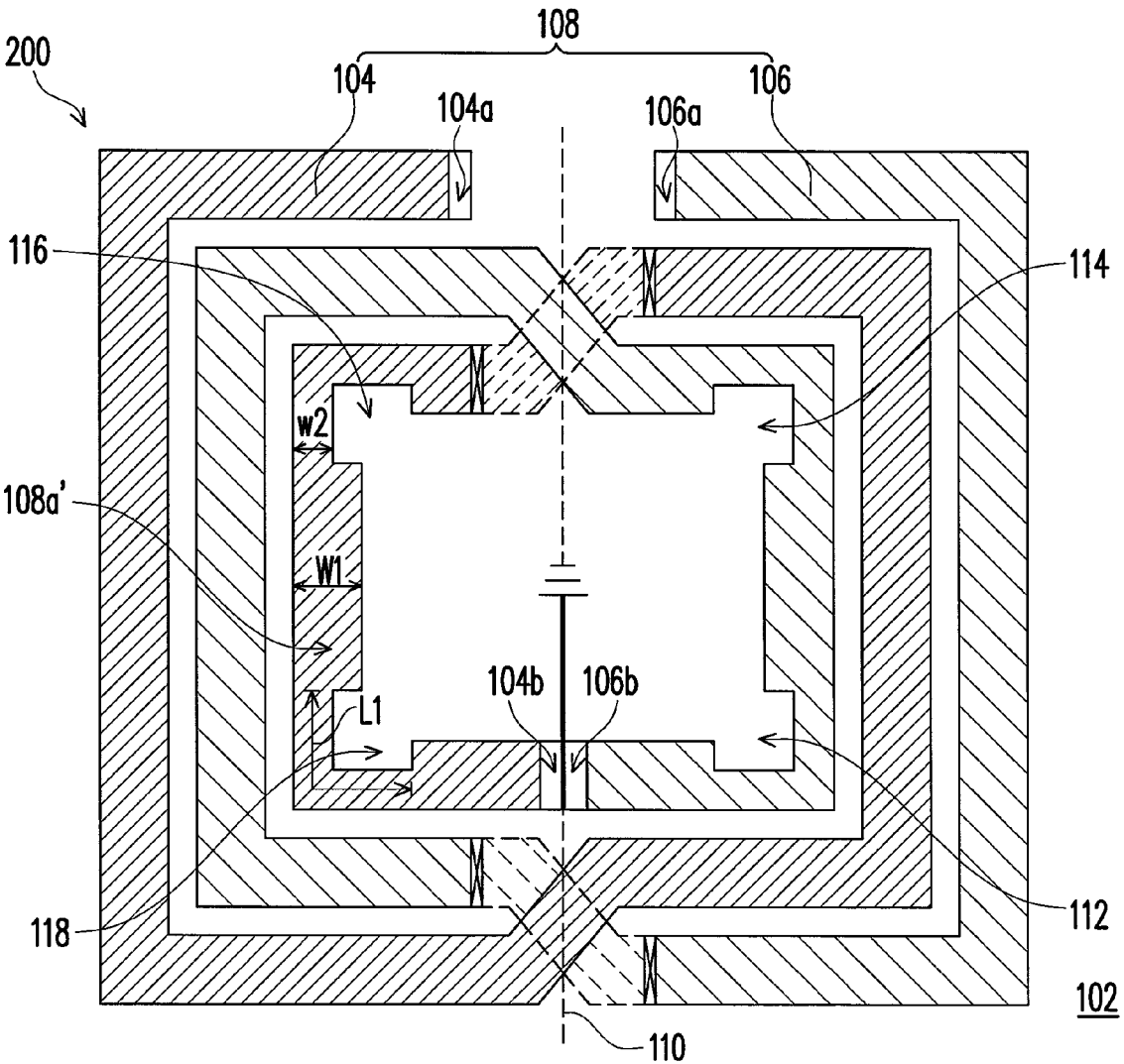
FIG. 2 is a top view of an inductor structure according to a second embodiment of the present invention.
Figure 3:
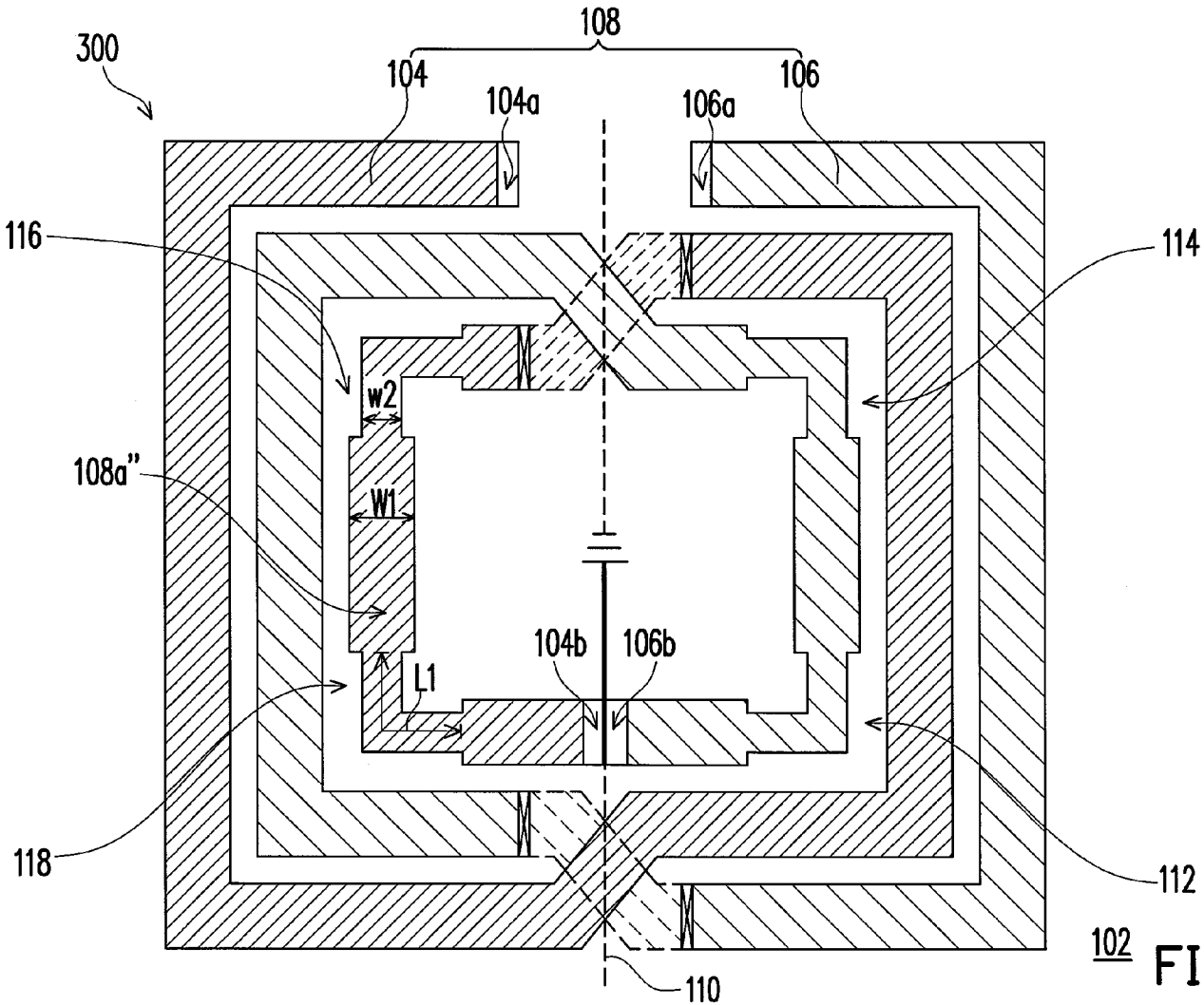
FIG. 3 is a top view of an inductor structure according to a third embodiment of the present invention.

FIG. 2 is a top view of an inductor structure according to a second embodiment of the present invention. FIG. 3 is a top view of an inductor structure according to a third embodiment of the present invention. In FIGS. 2 and 3, like element numerals are used to indicate like elements appearing in FIG. 1, and the details will not be described herein again.

Referring to FIGS. 1 to 3 together, the difference between the inductor structures 200, 300 in the second and third embodiments and the inductor structure 100 in the first embodiment is the positions of the removed portions of the innermost coil turn in each of the innermost coil turns 108*a*, 108*a*', 108*a*" having the portions with a narrower width. In detail, the removed portions of the innermost coil turn in the first embodiment are at the outer side of the innermost coil turn 108*a*, the removed portions of the innermost coil turn in the second embodiment are at the inner side of the innermost coil turn 108*a*', and the removed portions of the innermost coil turn in the third embodiment are at both the inner and outer side of the innermost coil turn 108*a*". Further, the materials and effects of other means of the inductor structures 200, 300 of the second and third embodiments are similar to those of the first embodiment, and the details will not be described herein again.

Since the inductor structures 200, 300 in the second and third embodiments are similar to the inductor structure 100 in the first embodiment, i.e. the innermost coil turns 108*a*, 108*a*', 108*a*" have a portion with a narrower width at each of the four bends 112, 114, 116, 118, such that the eddy current and the parasitic capacitance are reduced, and the inductor quality is improved.

FIG. 4 is a top view of an inductor structure according to a fourth embodiment of the present invention.

Referring to FIG. 4, the inductor structure 400 is disposed over a substrate 402. Since the inductor structure 400 is realized by a semiconductor process, the substrate 402 may be a silicon substrate. A coil layer 404 may be made of a metal, for example, Cu or Al—Cu alloy. Further, in this embodiment, the inductor structure 400 is, but not limited to, polygonal-shaped, as shown in FIG. 4.

The coil layer 404 is, for example, but not limited to, a three-turn spiral coil structure formed by coils 406, 408, 410 connected in series.

In addition, the coil layer 404 has two terminals 404*a*, 404*b*. The terminal 404*b* is located on an innermost coil turn 406 of the coil layer 404, and the terminal 404*a* is located on an outermost coil turn 410 of the coil layer 404. The terminal 404*b* is grounded, and the other terminal 404*a* is connected to an operating voltage, which is the application of a single-ended inductor.

It should be noted that in the fourth embodiment, for example, the terminal 404*b* inside the inductor structure 400 is grounded, and the innermost coil turn 406 of the coil layer 404 is grounded. However, in other embodiments, the terminal out of the inductor structure is grounded, so as to make the outermost coil turn of the coil layer grounded.

In the inductor structure 400, each of the coil turns is in a shape of quadrangle with four bends. The innermost coil turn 406 of the coil layer 404 has four bends 412, 414, 416, and 418, and has a portion with a narrower width at each of the four bends 412, 414, 416, and 418. It should be noted that though in this embodiment, the innermost coil turn 406 have a portion with a narrower width at each of the four bends 412, 414, 416, and 418, the eddy current and the parasitic capacitance can be reduced, as long as the inductor structure 400 has a portion with a narrower width at at least one bend.

The structure of the innermost coil turn 406 is formed by, for example, removing a portion of the coil at the outer side of the innermost coil turn 406 with an initial width W3 at each of the four bends 412, 414, 416, 418, so as to form a narrower width W4 at each of the four bends 412, 414, 416, 418.

It should be noted that the eddy current can be reduced as long as the width W4 at each bend is smaller than the width W3, and those of ordinary skill in the art can adjust the width W4 according to design requirements of the inductor structure 400. On the other hand, the length L2 of the portion with a narrower width W4 in the innermost coil turn 406 is not particularly limited, and those of ordinary skill in the art can adjust the length L2 according to design requirements of the inductor structure 400.

It may be known from the fourth embodiment that, the innermost coil turn 406 of the inductor structure 400 has portions with a narrower width in regions with a higher magnetic flux density (i.e., at the bends 412, 414, 416, 418), and thus the eddy current can be greatly reduced, and the inductor quality can be improved. Moreover, since the flow path of the induction current of the inductor structure 400 is not changed, the inductance will not be affected.

In addition, since the innermost coil turn 406 of the inductor structure 400 has portions with a narrower width, the parasitic capacitance between two adjacent coils can be reduced, and the inductor quality can be improved.

FIG. 5 is a top view of an inductor structure according to a fifth embodiment of the present invention. FIG. 6 is a top view of an inductor structure according to a sixth embodiment of the present invention. In FIGS. 5 and 6, like element numerals are used to indicate like elements appearing in FIG. 4, and the details will not be described herein again.

Referring to FIGS. 4 to 6 together, the difference between the inductor structures 500, 600 in the fifth and sixth embodiments and the inductor structure 400 in the fourth embodiment is the positions of the removed portions of the innermost coil turn in each of the innermost coil turns 406, 406', 406" having the portions with a narrower width. In detail, the removed portions of the innermost coil turn in the fourth embodiment are located at the outer side of the innermost coil turn 406, the removed portions of the innermost coil turn in the fifth embodiment are located at the inner side of the innermost coil turn 406', and the removed portions of the innermost coil turn in the sixth embodiment are located at both the inner and outer sides of the innermost coil turn 406". Further, the materials and effects of other means in the inductor structures 500, 600 of the fifth and sixth embodiments are similar to those of the fourth embodiment, and the details will not be described herein again.

Since the inductor structures 500, 600 in the fifth and sixth embodiments are similar to the inductor structure 400 in the fourth embodiment, i.e. the innermost coil turns 406, 406', 406" have a portion with a narrower width at each of the four bends 412, 414, 416, 418, such that the eddy current and the parasitic capacitance are reduced, and the inductor quality is improved.

In view of the above, the aforementioned embodiments at least have the following advantages.

1. The inductor structure of the present invention can effectively reduce the eddy current, and improve the inductor quality.

2. The inductor structure of the present invention can greatly reduce the parasitic capacitance, and improve the inductor quality.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inductor structure, disposed over a substrate, comprising:

a coil layer, comprising a plurality of coil turns electrically connected with each other, and an innermost coil turn of the coil layer has a plurality of bend regions, wherein turn widths of the entire bend regions of the innermost coil turn are narrower than turn widths of entire non-innermost coil turns of the coil layer and entire non-bend regions of the innermost coil turn.

2. The inductor structure according to claim 1, wherein a shape of each of the coil turns comprises polygon.

3. The inductor structure according to claim 1, wherein in at least one of the bend regions of the innermost coil turn, a removed portion of the innermost coil turn is located on inner and outer sides of the innermost coil turn.

4. The inductor structure according to claim 1, wherein in at least one of the bend regions of the innermost coil turn, a removed portion of the innermost coil turn is located on an inner side or an outer side of the innermost coil turn.

5. The inductor structure according to claim 1, wherein a coil turn of the coil layer is grounded.

6. The inductor structure according to claim 1, wherein the coil layer comprises:

a first spiral coil; and a second spiral coil, wherein the second spiral coil and the first spiral coil are wound symmetrically about a symmetry plane, one terminal of the second spiral coil is connected to one terminal of the first spiral coil, so as to form the coil layer with the plurality of coil turns, each coil turn is in a shape of polygon.

7. The inductor structure according to claim 6, wherein in at least one of the bend regions of the innermost coil turn, a removed portion of the innermost coil turn is located on inner and outer sides of the innermost coil turn.

8. The inductor structure according to claim 6, wherein in at least one of the bend regions of the innermost coil turn, a removed portion of the innermost coil turn is located on an inner side or an outer side of the innermost coil turn.

9. The inductor structure according to claim 6, wherein the coil turn connecting the first spiral coil and the second spiral coil is virtually grounded.

10. The inductor structure according to claim 6, wherein the first spiral coil and the second spiral coil are arranged in an alternating manner but not contacting each other on the symmetry plane.

11. The inductor structure according to claim 6, wherein the other terminal of the first spiral coil and the other terminal of the second spiral coil are respectively applied with voltages of a same absolute value but opposite electrical properties.

12. The inductor structure according to claim 11, wherein the bend regions are symmetrical about the symmetry plane.

13. The inductor structure according to claim 1, wherein the coil turns are serially connected, and each of the coil turns is in a shape of polygon.

14. The inductor structure according to claim 13, wherein in at least one of the bend regions of the innermost coil turn, a removed portion of the innermost coil turn is located on inner and outer sides of the innermost coil turn.

15. The inductor structure according to claim 13, wherein in at least one of the bend regions of the innermost coil turn, a removed portion of the innermost coil turn is located on an inner side or an outer side of the innermost coil turn.

16. The inductor structure according to claim 13, wherein a coil turn of the coil layer is grounded.

* * * * *